US012196226B2

(12) United States Patent
Castellone

(10) Patent No.: US 12,196,226 B2
(45) Date of Patent: Jan. 14, 2025

(54) ROTATING ASSEMBLY WITH INTEGRAL MAGNETIC FILTER FOR WET ROTOR CIRCULATING PUMP

(71) Applicant: Taco, Inc., Cranston, RI (US)

(72) Inventor: Joseph Castellone, Cranston, RI (US)

(73) Assignee: Taco, Inc., Cranston, RI (US)

( * ) Notice: Subject to any disclaimer, the term of this patent is extended or adjusted under 35 U.S.C. 154(b) by 57 days.

(21) Appl. No.: 18/036,103

(22) PCT Filed: Nov. 12, 2021

(86) PCT No.: PCT/US2021/059118

§ 371 (c)(1),
(2) Date: May 9, 2023

(87) PCT Pub. No.: WO2022/104042

PCT Pub. Date: May 19, 2022

(65) Prior Publication Data

US 2023/0407886 A1 Dec. 21, 2023

Related U.S. Application Data

(60) Provisional application No. 63/198,793, filed on Nov. 13, 2020.

(51) Int. Cl.

| | |
|---|---|
| ***F04D 29/70*** | (2006.01) |
| ***F04D 13/06*** | (2006.01) |
| ***F04D 29/06*** | (2006.01) |

(52) U.S. Cl.
CPC ..... *F04D 29/708* (2013.01); *F04D 13/0606* (2013.01); *F04D 29/061* (2013.01)

(58) Field of Classification Search
CPC ..... F04D 13/0606; F04D 13/0613; F04D 29/061; F04D 29/701; F04D 29/708; F04B 39/16
See application file for complete search history.

(56) References Cited

U.S. PATENT DOCUMENTS

| | | | | |
|---|---|---|---|---|
| 2,915,185 | A | 12/1959 | Waldherr et al. | |
| 4,047,847 | A * | 9/1977 | Oikawa | F04D 13/025 417/370 |
| 5,195,867 | A * | 3/1993 | Stirling | F16J 15/3404 415/111 |
| 2005/0069435 | A1 | 3/2005 | Ikeya et al. | |
| 2014/0377101 | A1 | 12/2014 | Muller | |
| 2021/0222699 | A1 * | 7/2021 | Gaba | F16C 33/76 |

FOREIGN PATENT DOCUMENTS

| | | | | |
|---|---|---|---|---|
| CN | 106989034 | A * | 7/2017 | A47L 5/22 |
| DE | 2160861 | A1 * | 6/1972 | |
| EP | 1211423 | A1 | 6/2002 | |
| EP | 1353074 | A2 * | 10/2003 | F04D 13/0633 |
| GB | 2491361 | A | 5/2012 | |
| JP | 2008121431 | A * | 5/2008 | |

* cited by examiner

*Primary Examiner* — Dominick L Plakkoottam
*Assistant Examiner* — Charles W Nichols
(74) *Attorney, Agent, or Firm* — Loeb & Loeb LLP

(57) ABSTRACT

A wet rotor circulating pump implementing an integral magnetic filter for removing suspended contaminates from the water being circulated.

2 Claims, 4 Drawing Sheets

ROTATING ASSEMBLY WITH INTEGRAL MAGNETIC FILTER FOR WET ROTOR CIRCULATING PUMP

TECHNICAL FIELD

The present invention relates generally to wet rotor circulating pumps, and in particular to a wet rotor circulating pump having an integral magnetic filter for removing suspended contaminants from the water being circulated, thus extending the useful life of the pump.

BACKGROUND OF THE INVENTION

Canned motor pumps, commonly known as "wet-rotor circulators" are widely used to circulate water in heating and plumbing systems. Canned motor pumps often use sleeve type bearings that require lubrication from the fluid being circulated to prevent noise, bearing and shaft damage (wear) and motor failure. For this reason, these pumps are most often referred to as water lubricated pumps or wet-rotor circulation pumps.

As long as the fluid being pumped is clean and free of contaminates, the water lubricated pump should run quietly and without damage to the bearings and shaft which can lead to noise or other failure. However, almost all heating systems contain contaminates in the water. These contaminates can be either suspended in the fluid or dissolved in the fluid.

Dissolved solids are in the form of minerals such as calcium carbonate (from limestone) and occur naturally or can enter the water from man-made sources. The calcium carbonate forms a bond with the oxygen in the water and cannot be mechanically filtered out of the water. Ferrous iron is also present in water as a dissolved solid but can become suspended once oxidized.

Suspended solids are not bonded with the water and can be in the form of minerals or in the form of ferric iron or magnetite and can be filtered out. Magnetite ($Fe_3O_4$) is a very common iron oxide which occurs naturally and is the most common form mined iron ore. In plumbing systems magnetite is formed as a result of galvanic corrosion between copper piping and cast iron and steel found in the pump and boiler or can be the result of ferrous iron oxidation.

In a wet-rotor circulation pump, the abrasive magnetite can build up in the bearing races causing bearing failure. In ECM motors which are comprised in part of magnetic rotors, magnetite can build up around the spinning magnets of the rotor causing premature pump failure.

Presently, magnetic dirt separators that filter out iron oxides and other solid particles are available to help protect circulators and other heating system components from the damage caused by magnetite particles in the piping system. Due to the costs associated with the installation of magnetic dirt separators, these add-on system components are usually removed from the original plumbing specification, or they may be completely left out. The result is premature equipment failure of the pump, air vents, and solder joints, or a fouling of the boiler's heat exchanger, all of which severely affects the system efficiency.

SUMMARY OF THE INVENTION

Thus, provided herein is a hot water circulation pump for a central heating system that eliminates the need to purchase and install a separate external magnetic filter or magnetic dirt separator by incorporating a magnetic filter within the rotor cartridge assembly and is removable for cleaning purposes, thereby extending the life of the hot water circulation pump and the central heating system. A wet rotor pump implements an integral magnet located in a space between the pump housing and motor and a mechanical filter around the front bearing support that allows for the filtering of iron oxides and other non-metallic suspended particulates. The wet rotor pump has a compartment that is comprised of a rotor can flange and front bearing support flange.

Moreover, a rotor cartridge is provided for a water lubricated pump, which has a filtering system comprising a circular or ring magnet over which the water entering the rotor chamber flows, thus attracting the magnetic particulate. A secondary mechanical filter is made of sintered bronze or polyester fiber in order to further eliminate iron and other non-metallic suspended particulate matter.

In particular, the present invention is a wet rotor circulating pump implementing an integral magnetic filter for removing suspended contaminates from the water being circulated, comprising a rotor housing; a filter cover juxtaposed with respect to the rotor housing so as to form a magnet chamber therebetween; in combination, a rotor, a shaft, bearing, and an impeller disposed within the rotor housing, wherein a bearing race is defined by a space between the bearing and the impeller; a baffle disposed within the magnet chamber; a secondary chamber cover juxtaposed with respect to the filter cover so as to form a secondary chamber therebetween; a mechanical filter disposed in proximity to the secondary chamber; and a ring magnet disposed within the magnet chamber in proximity to the baffle; wherein the filter cover comprises a plurality of magnetic chamber inlet ports disposed around the outer circumference of the filter cover to allow water to enter the pump; a plurality of secondary chamber inlet ports located so as to allow water to flow from the magnet chamber into the secondary chamber; and a plurality of mechanical filter inlet ports located so as to allow water to flow from the secondary chamber and be filtered by the mechanical filter; whereby water having suspended contaminates flows into enter the magnetic chamber via the plurality of magnetic chamber inlet ports and flows over the ring magnet, so that the ring magnet attracts metallic suspended contaminates from the water as it flows thereover, then enters the secondary chamber via the plurality of secondary chamber inlet ports and flows through the secondary chamber to flow through the bearing race to lubricate the bearing/shaft interface and through the mechanical filter via the plurality of mechanical filter inlet ports so that other suspended contaminates are filtered from the water by the mechanical filter, such that the water that exits the pump has been magnetically and mechanically filtered of suspended contaminates.

DETAILED DESCRIPTION OF THE INVENTION

Figure 1:
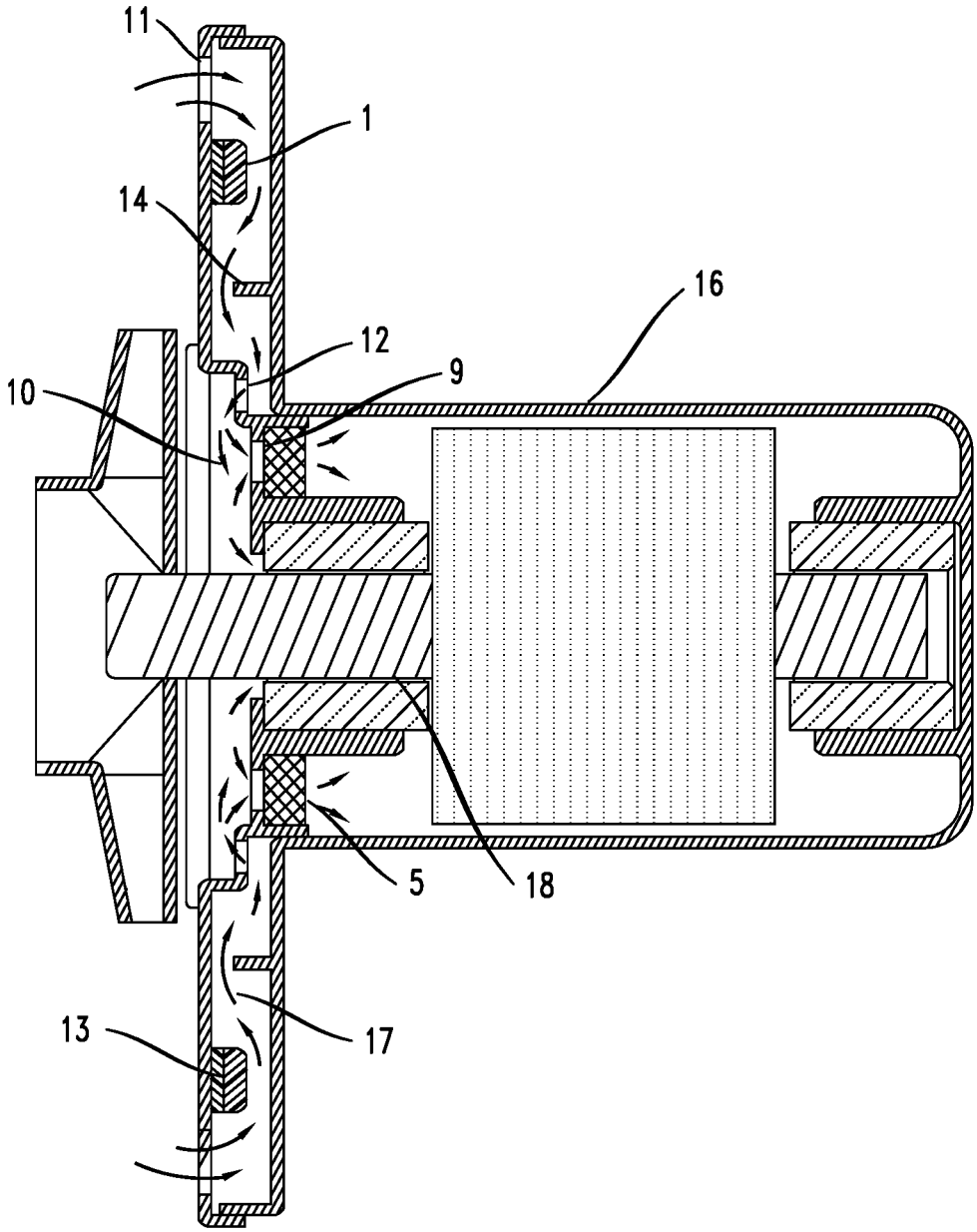
FIG. 1 is a cross-sectional view of a preferred embodiment water circulation pump of the present invention, which also illustrates the flow path of water through the pump.
Figure 2:
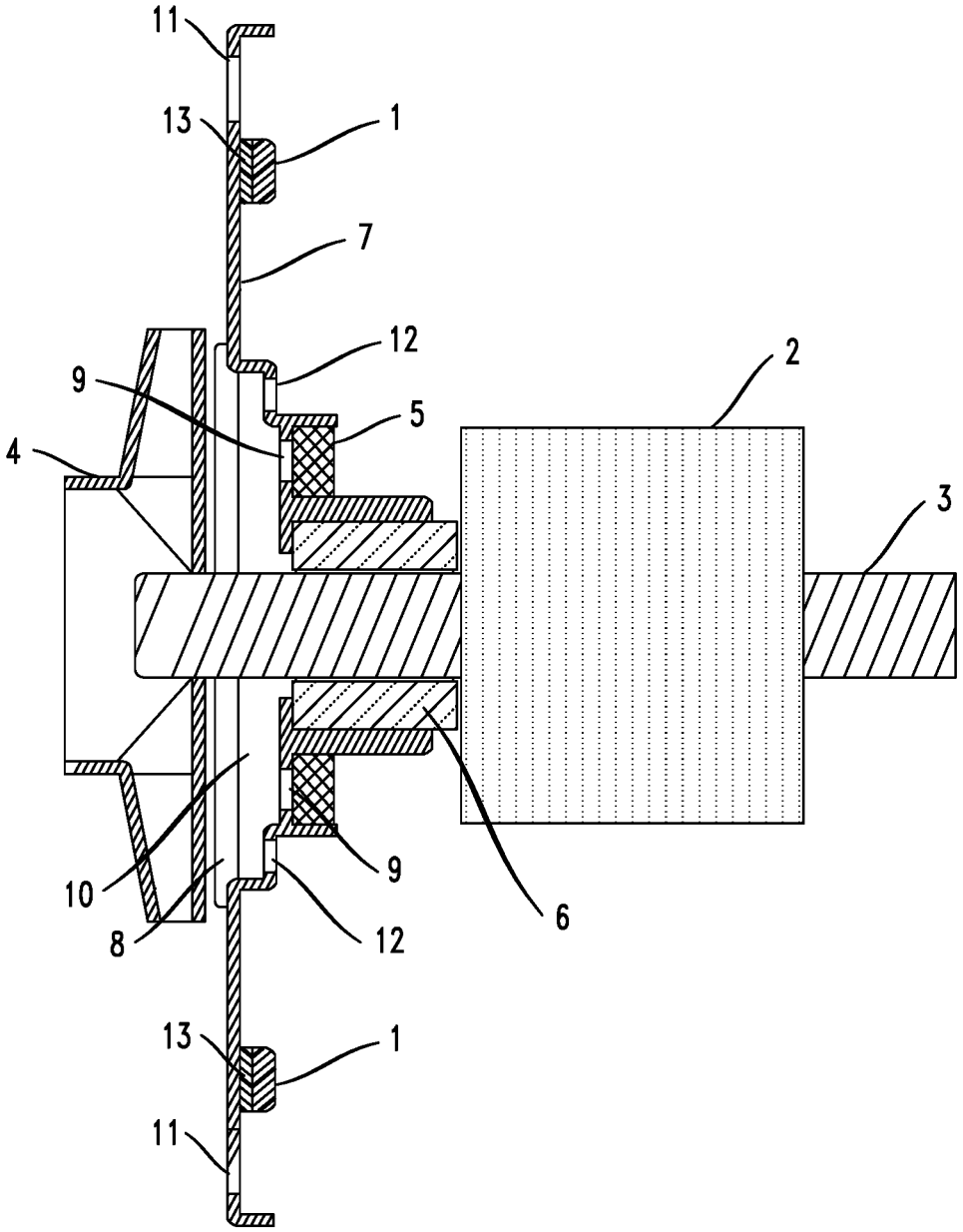
FIG. 2 illustrates the removable rotating element of the preferred embodiment pump of FIG. 1.
Figure 4:
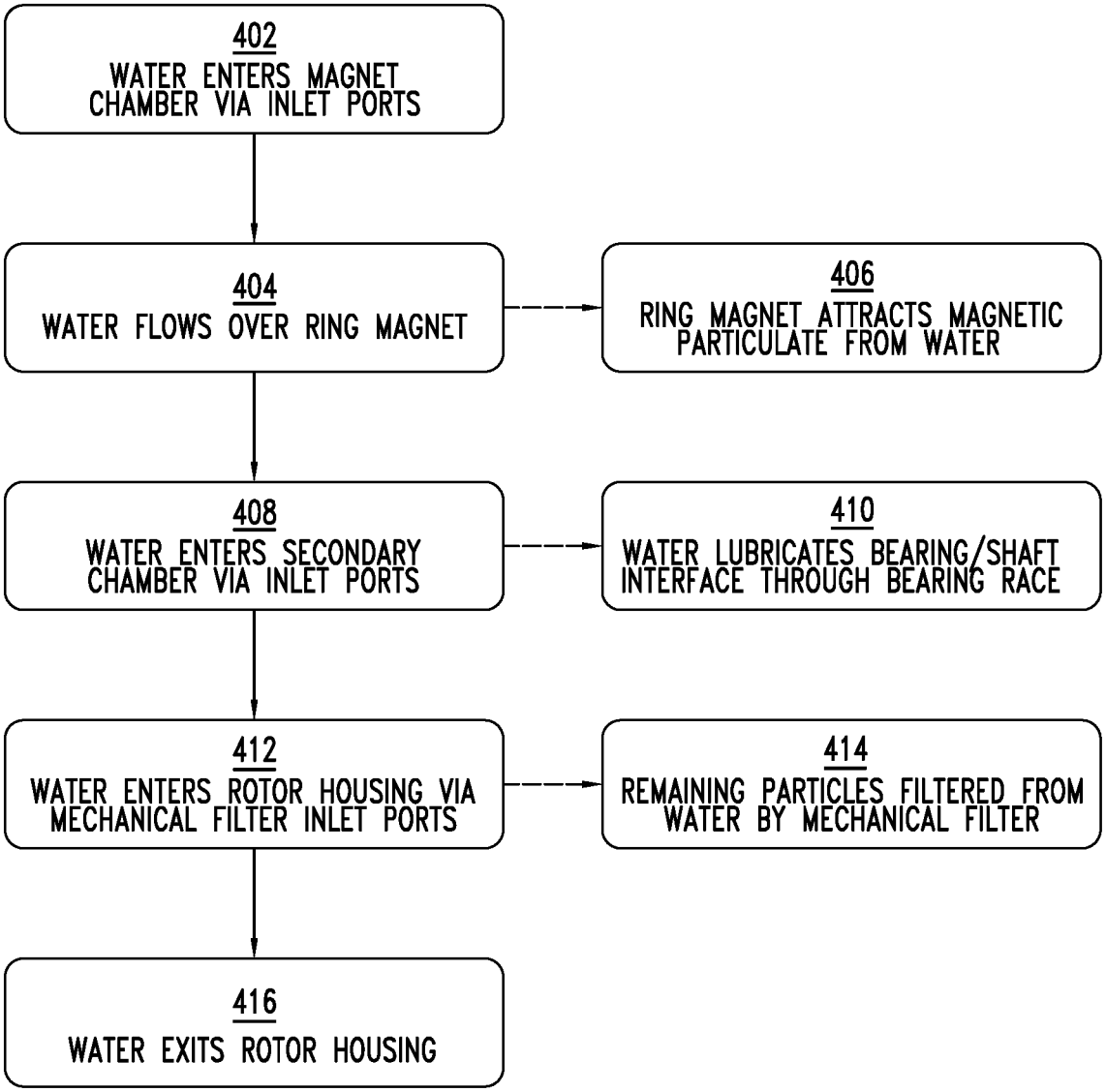
FIG. 4 is a flowchart depicting the flow of water through the preferred embodiment pump of FIG. 1

Shown in FIG. 1 is a cross-sectional view of a preferred embodiment water circulation pump of the present invention, which also illustrates via the set of arrows the flow path of water through the pump (see also FIG. 4). The preferred embodiment as shown in FIG. 1 includes a rotor housing 16 detachably attached to a removable rotating element as shown in FIG. 2. The removable rotating element includes a rotor 2 and shaft 3 attached to an impeller 4. A bearing 6 and a bearing and filter support cover, generally indicated by the numeral 20, is juxtaposed with respect to the impeller 4, including a bearing race 18 as shown in FIG. 1, through which lubricating water flows. An annular magnetic and filter flow chamber 17 is defined by the separation between the rotor housing flange 16 and the bearing and filter flange 20 as shown. A ring magnet 1 is disposed within the magnetic chamber 17, and a baffle 14 integral with the housing 16 is disposed so as redirect the water flow to ensure it flows in close proximity to all three exposed sides of the ring magnet 1.

Figure 3:
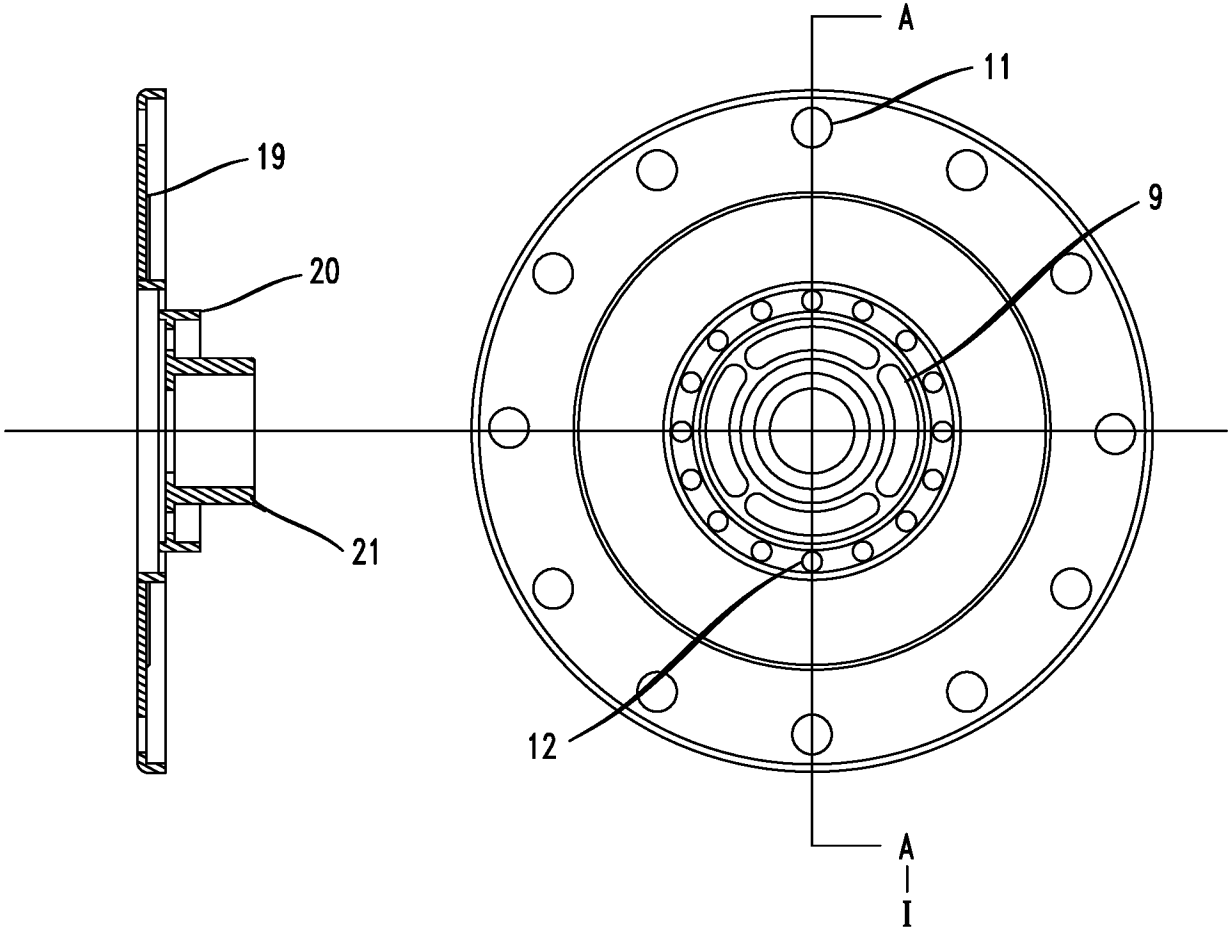
FIG. 3 illustrates the magnetic base of the preferred embodiment pump of FIG. 1.

As also shown in FIG. 3, a plurality of magnetic chamber inlet ports 11 are disposed around the outer circumference of the filter cover 20 to allow water to enter the pump as will be further described below.

A magnetic shield 13 is provided juxtaposed between the ring magnet 1 and the bearing and filter flange 20 to weaken the magnetic field outside of the magnet chamber 17, thusly preventing the buildup of magnetic particulates outside of the chamber.

A central, secondary flow chamber 10 is defined by the juxtaposition of the filter flange 20 and a secondary chamber cover 8 as shown in FIG. 2. As shown in particular in FIG. 3, a plurality of secondary chamber inlet ports 12 are located so as to allow water to flow from the magnetic chamber 17 into the secondary chamber 10 as will be further described below.

As further shown in FIG. 3, a plurality of mechanical filter inlet ports 9 are disposed around the inner circumference of the filter flange 20 to filter the water via mechanical filter (e.g. sintered metal) as it flows from the secondary chamber 10 as will be further described below. Also shown in FIG. 3 are magnetic shield/locator 19, mechanical filter support 20, and front bearing support 21.

Referring to the flowchart of FIG. 4, and as illustrated by the arrows in FIG. 1, water with metallic and non-metallic particulate enters the magnet chamber 17 at step 402 through the magnet chamber inlet ports 11 and flows over the high strength ring magnet 1 at step 404. The baffle 14 redirects the water flows to ensure it flows in close proximity to all three exposed sides of the ring magnet 1.

As a result, the water flowing in close proximity to and past the ring magnet 1 is now mostly devoid at step 406 of metallic particulate. The water then enters, at step 408, the secondary chamber 10 through the secondary chamber inlet ports 12, where at step 410 it provides lubrication to the bearing/shaft interface through the bearing race 18 which is sized to allow water but not large non-metallic particulate matter that can damage the bearings. At step 412, water also enters the rotor housing 16 through the mechanical filter inlet ports 9, and at step 414 any remaining particles are filtered from the water by the mechanical filter 5. The filtered water then exits at step 416 upon expansion and contraction of the water as the pump starts and stops.

As shown in FIG. 2, the rotating element is removable from the rotor can 16 for cleaning and clearing away of excessive buildup of magnetic particulates.

Comparative benefits and advantages of the present invention include:

- Compact, one pump replaces a pump and external magnetic filter
- Fewer mechanical connections, reducing the opportunity for leak
- Reduction in installation costs, component costs, system operating costs, and maintenance costs
- Extends the life of the pump and the central heating system
- Maintains overall system efficiency.

What is claimed is:

1. A wet rotor circulating pump implementing an integral magnetic filter for removing suspended contaminates from water being circulated, comprising a. a rotor housing;

b. a filter cover juxtaposed with respect to the rotor housing so as to form a magnet chamber therebetween, c. in combination, a rotor, a shaft, a bearing, and an impeller disposed within the rotor housing, wherein a bearing race is defined by a space between the bearing and the impeller;

d. a baffle disposed within the magnet chamber;

e. a secondary chamber cover juxtaposed with respect to the filter cover so as to form a secondary chamber therebetween, f. a mechanical filter disposed in proximity to the secondary chamber; and g. a ring magnet disposed within the magnet chamber in proximity to the baffle;

wherein the filter cover comprises i. a plurality of magnetic chamber inlet ports disposed around an outer circumference of the filter cover to allow water to enter the wet rotor circulating pump;

ii. a plurality of secondary chamber inlet ports located so as to allow the water to flow from the magnet chamber into the secondary chamber; and iii. a plurality of mechanical filter inlet ports located so as to allow the water to flow from the secondary chamber and be filtered by the mechanical filter;

whereby the water having suspended contaminates flows into enter the magnetic chamber via the plurality of magnetic chamber inlet ports and flows over the ring magnet, so that the ring magnet attracts magnetic, metallic, suspended contaminants from the water as the water flows thereover, then enters the secondary chamber via the plurality of secondary chamber inlet ports and flows through the secondary chamber to flow through the bearing race to lubricate the bearing interface and through the mechanical filter via the plurality of mechanical filter inlet ports so that other suspended contaminates are filtered from the water by the mechanical filter, such that the water that lubricates the bearings and exits the wet rotor circulating pump has been magnetically and mechanically filtered of suspended contaminants.

2. A method for a wet rotor circulating pump implementing an integral magnetic filter for removing suspended contaminates from water being circulated, comprising the steps of:

a. an impeller causing water, having suspended contaminates, to enter a magnetic chamber via a plurality of magnetic chamber inlet ports, the magnetic chamber located axially between the impeller and a motor;

b. causing the water in the magnetic chamber to flow over a ring magnet, whereby the ring magnet attracts metallic suspended contaminates from the water as it flows thereover;

c. causing water in the magnetic chamber to flow over a baffle, whereby the baffle redirects the flow to ensure the water flows in close proximity to all three exposed sides of the ring magnet;

d. causing the water to enter a secondary chamber via a plurality of secondary chamber inlet ports;

e. causing a first portion of the water flowing through the secondary chamber to flow through a bearing race and lubricate a bearing;

f. causing a second portion of the water flowing through the secondary chamber to flow through a mechanical filter via a plurality of mechanical filter inlet ports whereby other suspended contaminates are filtered from the water by the mechanical filter; whereby the water that exits the wet rotor circulating pump has been magnetically and mechanically filtered of suspended contaminates.

* * * * *